United States Patent [19]

Krämer et al.

[11] Patent Number: 4,505,311

[45] Date of Patent: Mar. 19, 1985

[54] MACHINE FOR DOSING, FILLING AND PACKAGING OF A DOUGHY OR PASTY FOOD SUBSTANCE

[75] Inventors: Erhardt Krämer, Ratingen; Dieter Möller, Haan; Ralph Brauer, Ratingen, all of Fed. Rep. of Germany

[73] Assignee: Benz & Hilgers GmbH, Duesseldorf, Fed. Rep. of Germany

[21] Appl. No.: 481,638

[22] Filed: Apr. 4, 1983

[30] Foreign Application Priority Data

Apr. 2, 1982 [DE] Fed. Rep. of Germany ..... 3212292

[51] Int. Cl.[3] ..... B65B 3/04

[52] U.S. Cl. ..... 141/129; 141/392; 198/560; 222/240; 222/412

[58] Field of Search ..... 141/83, 129, 163, 331, 141/18, 256, 257, 168, 392; 198/546, 548, 560, 168, 171, 281; 222/240, 412; 29/DIG. 1; 464/170; 426/392

[56] References Cited

U.S. PATENT DOCUMENTS

| | | | |
|---|---|---|---|
| 1,054,464 | 2/1913 | Soucek | 198/560 |
| 1,398,790 | 11/1921 | Ogur | 222/412 |
| 1,906,664 | 5/1933 | Thorne | 222/240 |
| 3,161,525 | 12/1964 | Hey | 426/392 |
| 3,424,209 | 1/1969 | Di Settembrini | 141/168 |

FOREIGN PATENT DOCUMENTS

| | | | |
|---|---|---|---|
| 10284 | of 1911 | United Kingdom | 141/255 |

*Primary Examiner*—Houston S. Bell, Jr.

[57] ABSTRACT

An improved machine for dosing, filling and packaging of a doughy or pasty food substance. The machine sequentially includes a trough, screw conveyor, guide channel, dosing station and forming channel. The forming channel widens in a funnel-like or obelisk-like fashion in the flow direction of the food substance which is being transported therethrough. At least a part of the guide channel is covered with a layer of friction-reducing material.

7 Claims, 9 Drawing Figures

MACHINE FOR DOSING, FILLING AND PACKAGING OF A DOUGHY OR PASTY FOOD SUBSTANCE

BACKGROUND OF THE INVENTION

The invention relates to a machine for dosing, filling and packaging of a doughy or pasty food substance, which is fed through at least one screw conveyor from a screw trough and via a guide channel of a dosing arrangement and via an adjoining forming channel (mouth piece) and finally towards at least one packaging container. After the doughy or pasty food substance has been filled into a plurality of packaging containers which have been sealed, the latter are packaged in a cardboard or other large package.

SUMMARY OF THE INVENTION

It is an object of this invention to provide a new type of packaging machine of the afore-described type which has a higher output than the known packaging machines.

It has been found to be particularly difficult to increase the output of packaging machines which package doughy or pasty food substances. This is due to the fact that the doughy or pasty substance offers a substantial resistance when being transported from a feed container via a guide channel into a dosing arrangement and eventually from there to an adjoining forming channel towards the packaging container, which resistance is due to the special consistency of the doughy and pasty food substance. Investigations and tests have been carried out to ascertain how to overcome this resistance by means of an installation in which the transport means are provided with a large drive capacity. This solution has been found to be impractical because the manufacturing price of the machine is increased to such an extent as a result of incorporating a large drive therein and also due to increased energy costs during the continuous operation of the machine.

The invention provides new means with which it is possible, despite maintaining the conventional drive capacity of the machine, to nevertheless increase the packaging capacity of the machine.

BRIEF DESCRIPTION OF THE DRAWING

With these and other objects in view, which will become apparent in the following detailed description, the present invention, which is shown by example only, will be clearly understood in connection with the accompanying drawing in which.

DETAILED DESCRIPTION

Figure 1:
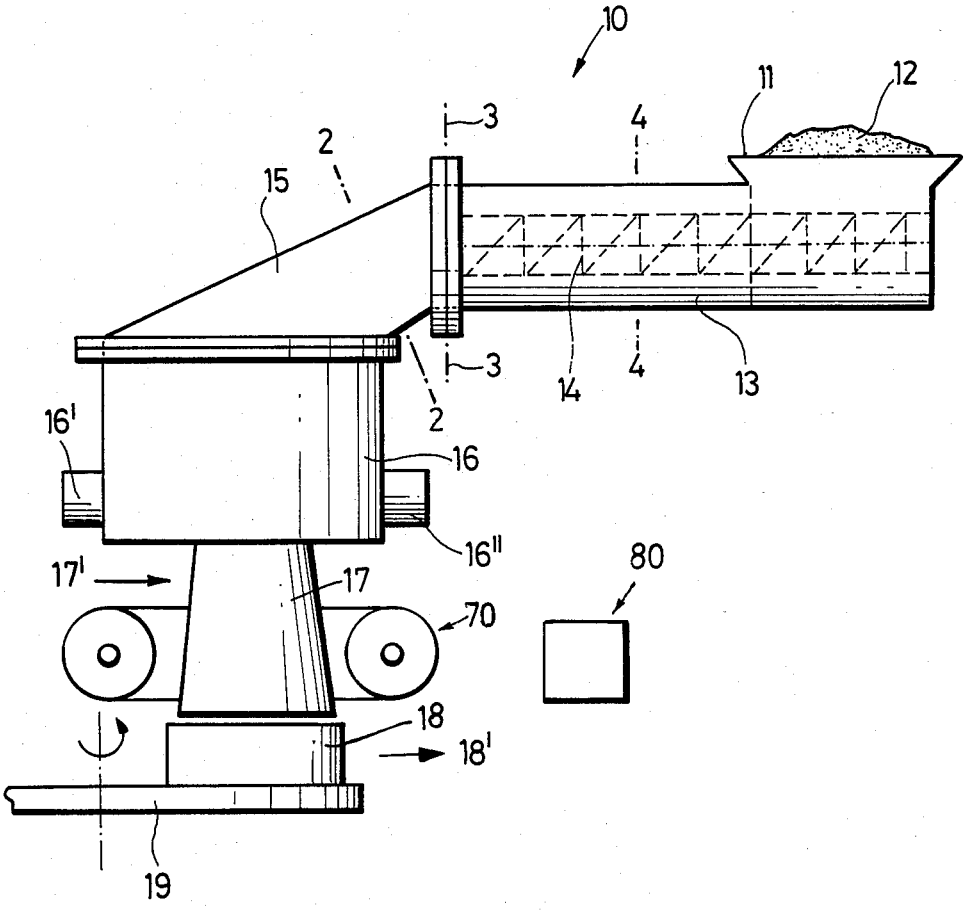
FIG. 1 is a schematic side-elevational view, not drawn to scale, of a machine for dosing, filling and packaging in accordance with this invention.

FIG. 1 illustrates schematically and not-to-scale a machine 10 for dosing, filling and packaging of a doughy or pasty food substance 12, which is fed via a trough or funnel 11 into a screw conveyor. From the screw conveyor it is transported by means of a transporting screw 14 via guide channel 15 to a dosing arrangement 16 where it is apportioned according to weight, respectively volume, and finally is fed into a packaging container 18 so as to fill it via a forming channel 17 (mouth piece). The packaging containers 18 so are transported towards the dosing station 17' via a rotating table 19 presenting a horizontal support surface. Alternately, the packaging containers 18 can also be directly manufactured at a non-illustrated folding station immediately prior to the packaging process and then be transported underneath the dosing station 17'. After filling and sealing of the packaging containers 18 the latter are transported via a transporting arrangement 70 to a collecting packaging station 80, in which a plurality of similar or identical packaging containers 18 are collected and packaged into a larger package.

Figure 2:
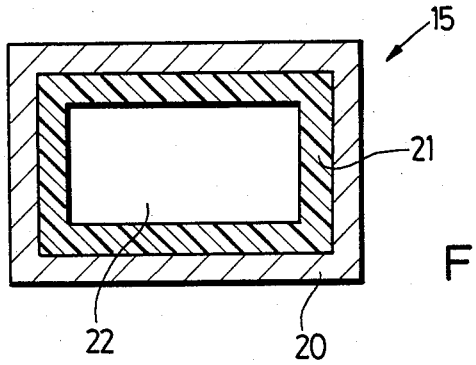
FIG. 2 is a cross-sectional view of a guide channel of a first embodiment of the invention along line 2—2 in FIG. 1.

The transporting of doughy or pasty food substances 12 from a filling funnel 11 through the machine 10 in the direction of the to be filled packaging containers 18 encounters in practice particularly significant operative difficulties when the food substance 12 has a more or less high viscosity which approximates a solid state. With the conventional machines there was, for example, observed that, in dependence of the prevailing condition of the food substance 12, a drastic reduction of the packaging output occurred; respectively a filling of the packaging container 18 would not occur at all when, within the machine 10 the transport path is completely clogged and the other conventional installed driving means are no longer capable to surmount the resistance offered by the flowing food substance. Occasionally a substantially reinforced driving arrangement can overcome this problem, whereby, however, increased manufacturing costs for the machine and substantially increased costs for operating the machine, as a result of the increased consumption of electrical energy must be taken into consideration. The machine in accordance with this invention uses a different approach which overcomes the operative problem hereinabove described. In particular the invention uses a funnel shape, respectively an obelisk-like widening at least in the feed channel 15 disposed between the screw conveyor 13 and the dosing arrangement 16 and also in the forming channel 17 which adjoins the dosing arrangement 16, which funnel-like widening is in the feed direction. Further, at least the feed channel 15 is covered with a friction reducing layer of material. A funnel-like widening of the feed channel 15 or the forming channel 17 is pertinent when these parts of the machine 10 have a circular-shaped cross-sectional surface. An obelisk-like widening is advantageous when the machine parts, as depicted in FIG. 2, have a rectangular shape or a square cross-sectional surface area 22. FIG. 2 represents a cross-section of the guide channel 15 of a first embodiment of the invention. In this embodiment there is disclosed a machine which has a guide channel 15, representing one transport path, the inner cross-section 22 of which is of rectangular shape. What is meant by a so-called "funnel-shaped, respectively obelisk-like widening" is a passage which has in lieu of the usual side wall surfaces which extend perpendicular with respect to the bottom wall surface side wall surfaces which in the direction of transport of the food substance 12 spread outwardly uniformly at a predetermined angle. In practice it has proven to be advantageous to use a 2% spreading angle between a reference plane, which plane is perpendicular to the base surface, and the inner channel surface of the guide channel 15 or the forming channel 17 which is directed outwardly.

By using such a construction a clogging along the transporting path of the food substance 12 is avoided and a constant flow of food substance is secured.

The transporting of the to be packaged food substance 12 within the machine 10 can advantageously by further facilitated in that at least the guide channel 15, which has additionally the task to deflect the transported food substance 12 from one direction into another direction, is smooth or covered by means of a friction-reducing layer 21 (FIG. 2). It has been advantageous to use as a friction-reducing layer 21 in particular for food substance-processing machines, a plastic substance, for example polytetraethylene fluoride (PTFE). Under certain circumstances it has proven to be advantageous to provide the channel or passage defined by the dosing arangement 16, which adjoins the forming channel 17, with such a friction-reducing layer. It is of course possible, to also clad further inner chambers and spaces of the machine 10, which come in contact with the food substance 12, with a friction-reducing layer.

Figure 3:
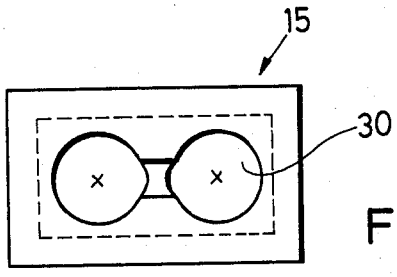
FIG. 3 is a cross-sectional view at the junction between feed trough and guide channel along line 3—3 of FIG. 1.
Figure 4:
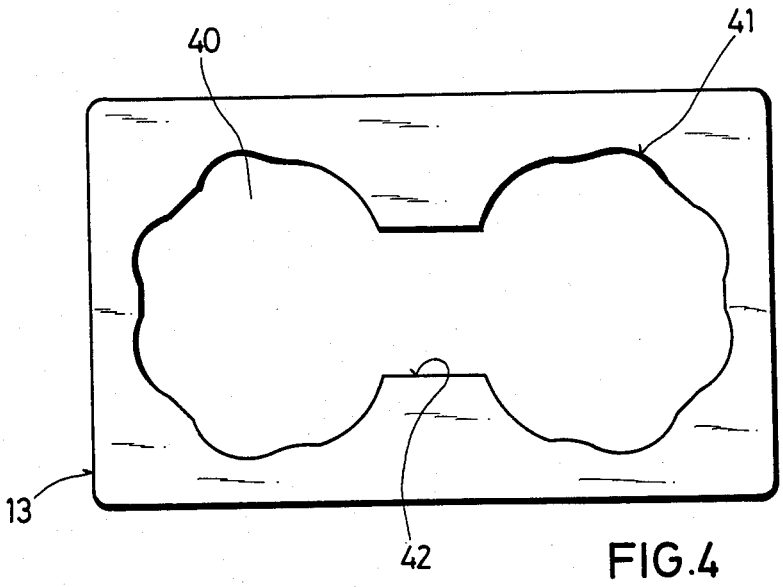
FIG. 4 is a cross-sectional view through the feed trough along line 4—4 of FIG. 1.

In a further embodiment of the invention the screw conveyor 13 includes two transport screws 14, rotating in opposite directions, which transport the food substance 12 in the direction towards the guide channel 15. In order to prevent a rotation of the transported food substance strands, which would inhibit the transporting process and which follows the rotating transport screws 14, there are arranged within the inner space 40 (FIG. 4) of the screw trough 13, guide grooves or indentations 41 mutually disposed adjacent to each other and in parallel with respect to each other which define between them the inner wall surfaces 42. The guide grooves 41 extend preferably parallel to the longitudinal axial direction of the hollow cylinder. FIG. 4 depicts a cross-sectional view through the screw trough 13 along line 4—4 of FIG. 1. Preferably this cross-sectional surface defines the guide groove 41 portion of a circular surface. In a further embodiment of the invention the guide channel 15 surrounds two spatially separated transportation paths which have a kidney-shaped opening 30 by means of the transported food substance 12 is received as it is being fed by the screw trough 13 (FIG. 3). Both of the two expanded portions of the kidney-shaped opening 30 are aligned with corresponding transporting zones of action of the conveyor screw 14.

Figure 5:
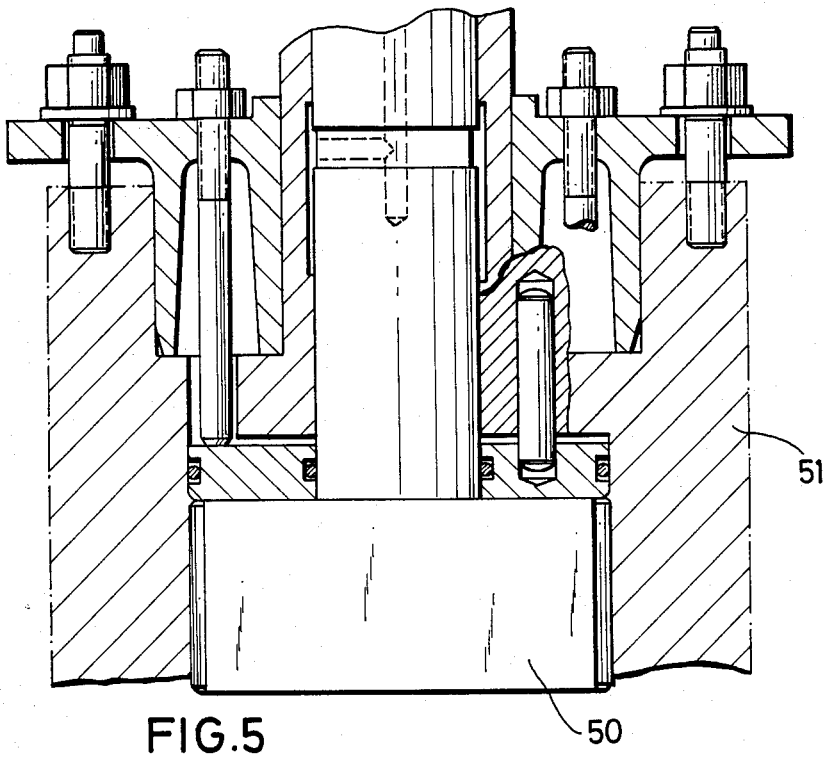
FIG. 5 is a sectional elevational view of the rotating slider shown with its support housing.
Figure 6:
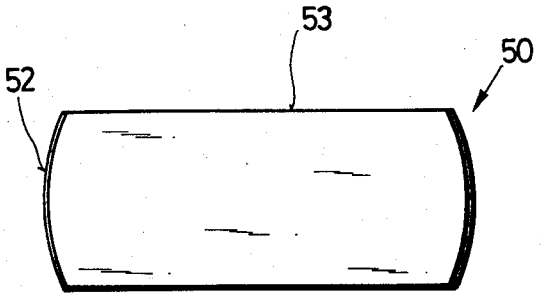
FIG. 6 is a front-elevational view of the end face of the rotating slider viewed in the direction of the arrow B in FIG. 5.

After the foods substance has traversed the guide channel 15 it reaches the dosing arrangement 16, in which it is, according to weight or volume, apportioned and fed thereafter to a forming channel 17 (mouth piece). The forming channel 17 has the object to introduce the apportioned food substance 12 into the packaging container 18 and thereby to shape it into a shape which is adapted to that of the packaging container 18. For example, the forming channel 17 can have a rectangular cross-sectional surface in order to produce a rectangular or square-shaped strand of food substance 12. The dosing arrangement 16 does itself encompass a rotating slider 50, known per se, which is illustrated in detail in FIGS. 5 and 6. The rotatable slider 50, which is preferably freely rotatably mounted, assumes in a known manner two non-illustrated positions. In a first position it permits the passage of the food substance 12 towards an only schematically illustrated dosing cylinder 16', respectively 16" (see FIG. 1) during this operative step there is no communication between the dosing cylinder and the forming channel 17. In a subsequent position of the rotatable slider 50 there is established a communication between the first dosing cylinder 16', respectively 16", towards the forming channel 17, so that thereby firstly the food substance disposed within the dosing cylinder 16' is expelled into the packaging container 18. Simultaneously, the other dosing cylinder 16" is filled with the following dosed food substance. The dosing cylinders are actuated in a known manner hydraulically, electrically, or mechanically. As is particularly illustrated in FIG. 6 the rotatable slider 50 is floatingly mounted in its own housing 51 (FIG. 5). The rotatable slider 50 is confronted at diametrically opposite sides on the one hand by flat surfaces 53 and on the other hand by cylindrical surrounding surfaces 52 in such a way that it is formed disc-like, and that the cylindrical surrounding surfaces 53 have a limited circumferential extent, preferable subtending an angle of 120 degrees, thereby there is attained that only a relatively small peripheral surface of the rotatable slider 50 confronts the housing wall surface, whereby a friction-reduction during the rotational movement of the rotatable slider is attained. This friction-reduction contributes also to an increase in the transportation output of the arrangement.

Figure 7:
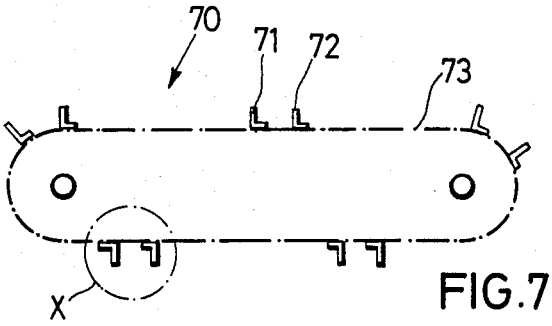
FIG. 7 is a schematic elevational view of a conveyor arrangement for transporting the packaging containers, which arrangement has at its periphery a toothed belt on which entraining units are mounted.
Figure 8:
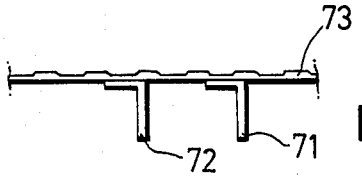
FIG. 8 illustrates in elevation a detail of the toothed belt of the arrangement of FIG. 7 in the area circled by a dot-dash circle marked X in FIG. 7.
Figure 9:
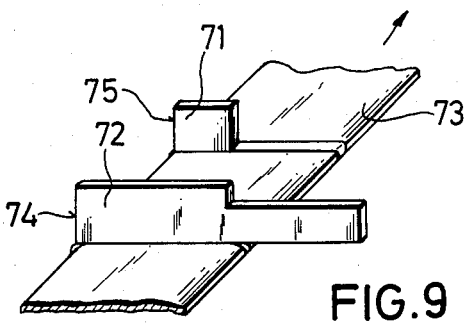
FIG. 9 is an enlarged perspective view of a portion of the entraining units mounted on the toothed belt of the conveyor arrangement of FIG. 7.

In the region of the dosing station 17' the packaging containers 18 are filled by means of a predetermined mass of food substance and are thereafter sealed. After such sealing the container is moved outwardly in a radial direction by means of a transport arrangement 70 (FIG. 1) onto which it is transferred. The transport arrangement 70 moves the containers to a collection packaging station 80 of the machine 10 which is arranged above the rotary table 19. At this collection packaging station a plurality of identical or similar packaging containers 18 are assembled for purposes of a larger collected packaging. The transport arrangement 70 is illustrated in detail in FIGS. 7, 8 and 9. The transport arrangement 70 includes an endless rotating toothed belt 73, which has pairs of entraining members 71, 72 mounted equi-distantly on the toothed belt 73. As can be particularly noted from the enlarged depiction in FIGS. 8 and 9 the entraining members are arranged parallel with respect to each other and extend laterally with respect to the transportion direction of the toothed belt 73. The entraining units 71, 72, arranged in mutual pairs on the toothed belt 73, are mutually spaced from each other in such a way that they present aligned surfaces 74, 75 at one side. As can be noted, the entraining unit 71 has a substantially smaller entraining surface, moving in the transportation direction of the toothed belt 73, as has the following entraining unit 72. This has the following consequence: The smaller entraining surface of the training unit 71 engages eccentrically at the side edge of the packaging container 18 having a rectangular cross-section, and turns it about 90 degrees. Immediately thereafter the following entraining units 72, with respect to the direction of movement of the toothed belt 73, engages the now rearwardly disposed edge of the packaging container 18 and transports it in the direction of the arrow towards the packaging station 80. The aforedescribed steps are required because the packaging container 18 assumes in the region of the dosing station 17 a different position as it does in the collection packaging station 80.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. An improved machine for dosing, filling, and packaging of a doughy or pasty food substance, which is transported by at least one screw conveyor from a conveyor trough via a guide channel to a dosing arrangement and therefrom via an adjoining forming channel is fed into at least one packaging container which is thereafter packaged into a larger collecting package, the improvement comprising, the guide channel being located between the outlet of the conveyor trough and entrance side of the dosing arrangement, said dosing arrangement being located laterally below the conveyor trough, and redirecting the food substance being conveyed;

the forming channel being connected to the outlet of the dosing arrangement;

wherein the cross-sectional size of both guide channel and forming channel increase in a funnel-like or obelisk-like fashion in the direction of feed;

said guide channel being covered with a layer of material having friction reducing properties.

2. The improvement in a machine for dosing, filling and packaging a doughy or pasty food substance as set forth in claim 1, wherein said screw conveyor defines a first inner chamber, said first inner chamber defining at least partially two parallel substantially cylindrical surfaces which longitudinally extend in the feed direction of the food substance and two opposite flat surfaces which are disposed between the two parallel cylindrical surfaces, said pair of cylindrical surfaces having a plurality of longitudinal extending grooves.

3. The improvement in a machine for dosing, filling and packaging a doughy or pasty food substance as set forth in claim 1, wherein said guide channel is kidney-shaped in cross-section and defines two spatially separate conveyor paths which are adapted to receive the food substance being transported by said conveyor screw.

4. The improvement in a machine for dosing, filling and packaging a doughy or pasty food substance as set forth in claim 1, wherein said dosing arrangement includes in housing in which a slider is floatingly freely rotatably mounted, said slider is disk-shaped and has a periphery which includes a pair of opposite cylindrical surfaces and a pair of opposite plane surfaces; each cylindrical surface of said pair of cylindrical surfaces subtends an arc of less than 120 degrees.

5. The improvement in a machine for dosing, filling and packaging a doughy or pasty food substance as set forth in claim 1, including endless toothed belt conveyor means operatively mounted in said forming channel which is adapted to transport a filled container to a collecting packaging station, a plurality of pairs of entraining units are equi-distantly mounted on said endless toothed belt conveyor.

6. The improvement in a machine for dosing, filling and packaging a doughy or pasty food substance as set forth in claim 5, wherein said entraining units are mutually parallel and extend transversely with respect to the direction of movement of said toothed belt conveyor.

7. The improvement in a machine for dosing, filling and packaging a doughy or pasty food substance as set forth in claim 6, wherein the entraining units of each pair have one of their lateral sides mutually aligned and the first entraining unit of each pair, with respect to the direction of movement of said toothed belt conveyor, has a substantially smaller surface than the second entraining unit with respect to same direction of movement.

* * * * *